US005494462A

United States Patent [19]

Auclair

[11] Patent Number: 5,494,462

[45] Date of Patent: Feb. 27, 1996

[54] GROUND ROD CLAMP

[75] Inventor: William T. Auclair, Winsted, Conn.

[73] Assignee: Electric Motion Company, Inc., Winsted, Conn.

[21] Appl. No.: 237,582

[22] Filed: May 3, 1994

[51] Int. Cl.[6] ..... H01R 4/36

[52] U.S. Cl. ..... 439/810; 411/300

[58] Field of Search ..... 439/803, 807–814, 439/411, 475; 411/300–305

[56] References Cited

U.S. PATENT DOCUMENTS

| | | | |
|---|---|---|---|
| 2,445,125 | 7/1948 | Reyburn et al. | 411/300 |
| 2,545,927 | 3/1951 | Lockwood | 411/300 |
| 3,550,668 | 12/1970 | Coyle | 411/302 |
| 3,622,946 | 11/1971 | Rogers | 439/475 |
| 4,911,572 | 3/1990 | Williams | 439/803 |
| 4,917,615 | 4/1990 | Franks, Jr. | 439/814 |
| 5,041,026 | 8/1991 | Hansel | 439/813 |
| 5,173,066 | 12/1992 | Umeda | 439/803 |

FOREIGN PATENT DOCUMENTS

| | | | |
|---|---|---|---|
| 0277348 | 3/1990 | Germany | 439/814 |

*Primary Examiner*—David L. Pirlot
*Assistant Examiner*—Jill DeMello
*Attorney, Agent, or Firm*—Chilton, Alix & Van Kirk

[57] ABSTRACT

A ground rod clamp for clamping a ground rod and at least one ground wire employs a clamp body and a bolt. A transverse orifice in a first portion of the clamp body receives the ground rod and ground wire. A threaded portion of the bolt is received by a threaded axial bore in a second portion of the clamp body. The distal end of the bolt engages the ground rod and ground wires. Torquing the bolt head clamps the ground rod and ground wires within the clamp body.

19 Claims, 2 Drawing Sheets

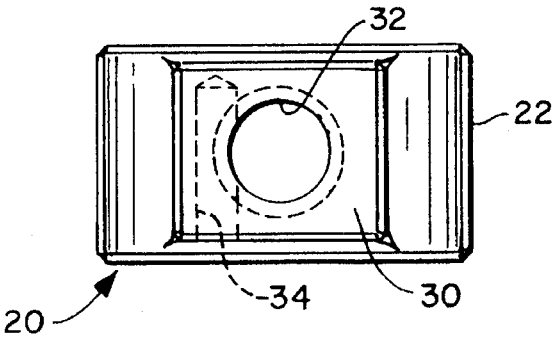
FIG. 4
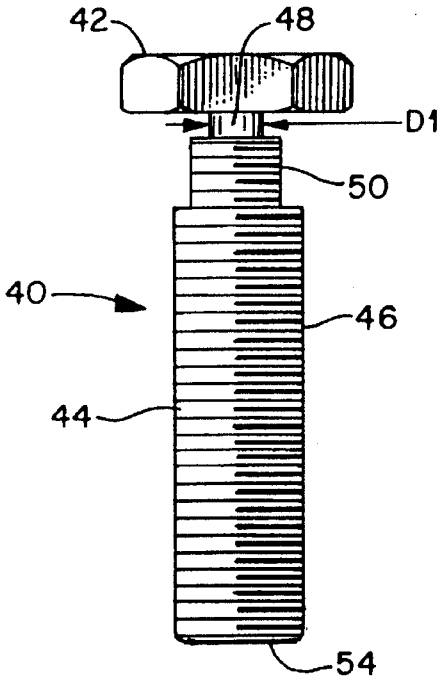
FIG. 6
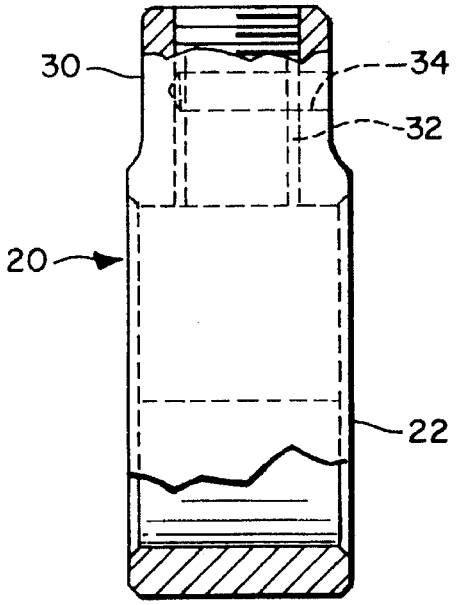
FIG, 5
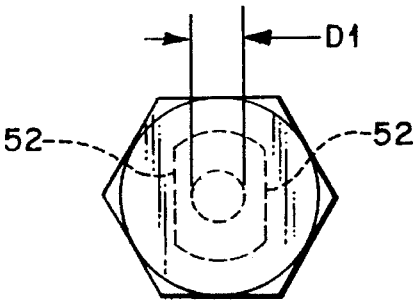
FIG. 7

GROUND ROD CLAMP

BACKGROUND OF THE INVENTION

This invention relates generally to ground rod clamps for clamping ground wires to a ground rod.

A number of ground rod clamps have been developed for making connections to a ground rod. The ground rod clamps employ various structures for establishing an electrical connection between the ground rod and the ground wires. Such connections may be susceptible to loosening due to vibration, especially where multiple ground wires are connected.

Ground rods will very often deform at the top into a "mushroom-like" configuration on being hammered into the ground. Conventional ground rod clamps may be difficult or impossible to install when such ground rod deformation occurs.

SUMMARY OF THE INVENTION

Briefly stated, the invention in a preferred form is a ground rod clamp for connecting a ground rod with at least one ground wire. The clamp assembly comprises a clamp body having a first portion having a transverse opening for receiving the ground rod and ground wires. A clamp body second section has a threaded axial bore that threadably receives a threaded shank section of a bolt. The distal end of the bolt shank is threadably movable within the clamp body transverse bore for engagement with the ground rod and ground wires. Torquing the bolt clamps the ground rod and ground wires within the transverse opening. The ground rod clamp is composed of an electrically conductive material to facilitate forming the ground connection.

In a preferred embodiment, the ground rod clamp is composed of silicon bronze material, providing superior corrosion resistance and conductivity. A polymeric rod housed in a partial transverse bore in the clamp body second section partially engages the threaded bolt portion. This prevents the clamp from loosening if it is subjected to vibration. A first portion of the bolt shank adjacent the bolt head has a diameter dimensioned such that the bolt head will break away from the bolt shank when a predetermined amount of torque is applied to the bolt head. This prevents over or under torquing of the bolt, simplifying installation. A second portion of the bolt shank intermediate the first portion and the threaded portion has opposed flat surfaces. This allows removal of the clamp after the bolt head has been broken off during installation.

An object of the invention is to provide a new and improved ground rod clamp for implementing a ground connection between a ground rod and at least one ground wire.

Another object of the invention is to provide a new and improved ground rod clamp which can be efficiently installed on a ground rod that has already been driven into the ground.

A further object of the invention is to provide a new and improved ground rod clamp which does not loosen when subjected to vibrations.

A yet further object of the invention is to provide a new and improved ground rod clamp which will effectively clamp a plurality of ground wires to a ground rod.

Other objects and advantages of the invention will become apparent from the drawings and the specification.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which:

FIG. 4 is a top view,, partly in phantom, of the clamp body of FIG. 2;

FIG. 5 is a side view, partly in phantom and partly in section, of the clamp body of FIG. 2;

FIG. 6 is a side view of a bolt of the ground rod clamp of FIG. 1; and

FIG. 7 is a top view, partly in phantom, of the bolt of FIG. 6.

DETAILED DESCRIPTION OF THE PREFERRED EMBODIMENT

Figure 1:
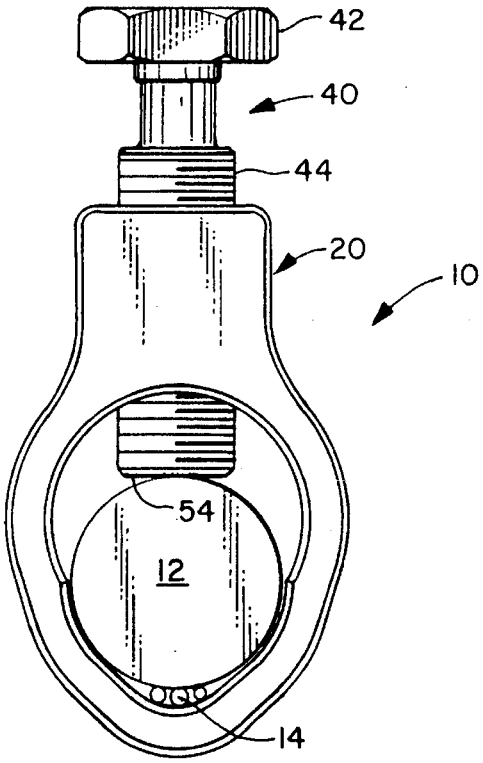
FIG. 1 is a front view of a ground rod clamp in accordance with the present invention, illustrated in conjunction with a ground rod and a plurality of ground wires.
Figure 2:
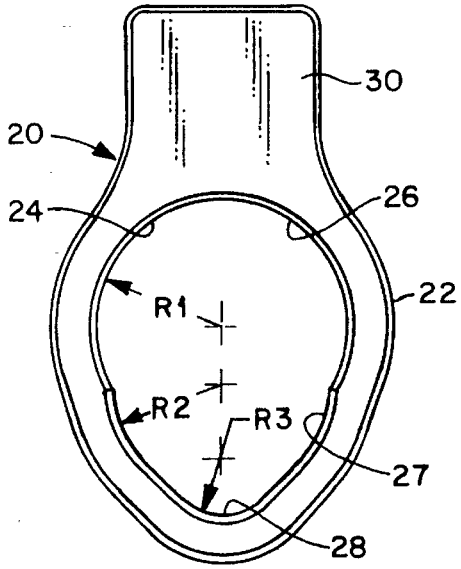
FIG. 2 is a front view of a clamp body of the ground rod clamp of FIG. 1.
Figure 3:
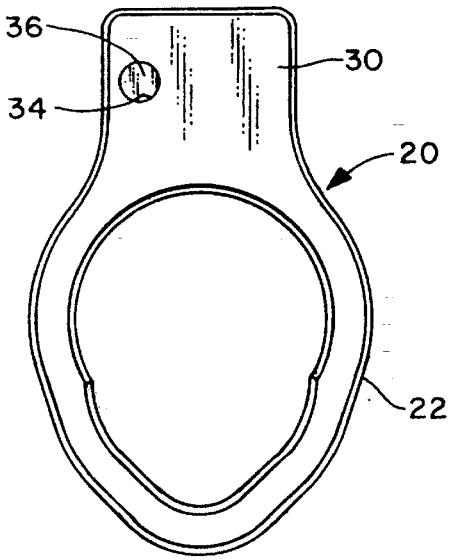
FIG. 3 is a rear view of the clamp body of FIG. 2.

With reference to the drawings, a ground rod clamp in accordance with the present invention is generally designated by the numeral 10. The ground rod clamp 10 is particularly adapted for receiving and clamping a ground rod 12 and one or more ground wires 14. The ground rod clamp 10 comprises a clamp body 20 and a bolt 40.

The ground rod clamp body 20 has two sections. The first section 22 has a transverse opening 24 having a first portion 26 and a second portion 27. In an alternate embodiment, there may be a third portion 28. The first portion has an inside radius R1, the second portion has an inside radius R2, and the third portion has an inside radius R3 wherein R1>R2>R3. The upper end of a ground rod 12 generally peens over into a mushroom-shape when the ground rod 12 is driven into the ground. The large upper radius R1 of the first portion accommodates a peened over ground rod 12, facilitating installation of the ground rod clamp 10 on a ground rod 12 that has already been driven into the ground. The ground rod 12 is passed through the largest radius opening and secured in the narrower second portion, as illustrated in FIG. 1. The small radius R3 of the third portion functions to define a quasi-U-shaped recess to facilitate clamping retention of the ground wires 14 in the clamp body 20 by preventing them from slipping around the ground rod 12.

The second section 30 has a threaded axial bore 32 which receives a clamp bolt 40.

The bolt 40 comprises a head 42 and a shank 44. A threaded portion 46 of the shank 44 is threadably received by the clamp body axial bore 32. In a preferred embodiment, a second portion of the shank 48, adjacent the head 42, has a reduced diameter D1. D1 is dimensioned such that the head 42 will break off of the shank 40 when a predetermined torque is applied to the head 42. This prevents over or under torquing of the bolt to provide an easier foolproof method of installation. A third portion of the shank 50, below the second portion 48, has opposed flat surfaces 52. The flats 52 facilitate removal of the clamp 10 after the head 42 has been broken off during installation by providing a gripping surface for a wrench, pliers or the like. The distal end 54 of the shank 44 engages the ground rod 12 and one or more ground wires 14 to clamp them together.

In a preferred embodiment, the clamp body second section 30 has a transverse blind bore 34. The transverse bore 34 partially intersects the axial bore 32 such that the transverse bore 34 is substantially tangential to the axial bore 32. A pin 36 composed of polymeric material is disposed in the transverse bore 34. The pin 36 is plastically and elastically deformed by the threaded shank portion 44. This deformation causes the pin 36 to engage the bolt threaded shank portion 44 with a high degree of frictional force. This force resists movement of the threaded shank portion 44, preventing the bolt 40 from loosening due to vibration.

The ground rod clamp 10 is composed of electrically conductive material to facilitate forming the ground connection. In a preferred embodiment, the ground rod clamp 10 is composed of silicon bronze material.

In one preferred embodiment, the clamp body upper portion 26 inside radius R1 equals 0.375 inches, the clamp body lower portion 28 inside radius R2 equals 0.328 inches, and the clamp body blind bore 34 has a diameter of 0.125 inches and a length of 0.44 inches.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A ground rod clamp comprising:

a clamp body having first and second portions, said first portion defining an axially elongated transverse opening, said opening having contiguous first, second and third sections, said first section having a radius R1, said second section having a radius R2, said third section having a radius R3, and wherein R1>R2>R3, said second portion defining a threaded axial bore; and bolt means having head means and shank means, said shank means having a threaded segment, said threaded segment being threadably mounted in said axial bore, said shank means being threadably displaceable into said opening.

2. The ground rod clamp of claim 1 wherein said first section is adjacent said clamp body second portion.

3. The ground rod clamp of claim 1 wherein said clamp body second portion defines a partial transverse bore, said transverse bore being substantially tangential to said axial bore.

4. The ground rod clamp of claim 3 further comprising pin means disposed in said transverse bore wherein said pin means engages said bolt means whereby said pin means resists movement of said bolt means.

5. The ground rod clamp of claim 4 wherein said pin means is comprised of polymeric material.

6. The ground rod clamp of claim 1 wherein said shank means has a first portion intermediate said head means and said threaded segment, said first portion and said threaded segment each having a diameter wherein said threaded segment diameter is greater than said first portion diameter.

7. The ground rod clamp of claim 6 wherein said first portion diameter is dimensioned whereby said head means breaks away from said shank means when a predetermined torque is applied to said head means.

8. The ground rod clamp of claim 6 wherein said shank means has a second portion intermediate said first portion and said threaded segment, said second portion having opposed flat surfaces.

9. The ground rod clamp of claim 1 wherein said clamp is composed of electrically conductive material.

10. The ground rod clamp of claim 9 wherein said clamp is composed of silicon bronze.

11. A ground rod clamp assembly comprising:

ground rod means;

ground wire means comprising at least one ground wire;

a clamp body having first and second portions, said first portion defining an axially elongated transverse opening for receiving said ground rod means and said ground wire means, said opening having contiguous first, second and third sections, said first section having a radius R1, said second section having a radius R2, said third section having a radius R3, and wherein R1>R2>R3, said second portion defining a threaded axial bore; and bolt means having head means and shank means, said shank means having a threaded segment, said threaded segment being threadably mounted in said axial bore, said shank means being threadably displaceable into said opening whereby said bolt means clamps said ground rod means and said ground wire means.

12. The ground rod clamp of claim 11 wherein said shank means has a first portion intermediate said head means and said threaded segment and a second portion intermediate said first portion and said threaded segment, said first and second portions each having a diameter wherein said second portion diameter is greater than said first portion diameter, said first portion diameter being dimensioned whereby said head means breaks away from said shank means when a predetermined torque is applied to said head means, said second portion having opposed flat surfaces.

13. The ground rod clamp of claim 11 wherein said clamp body and said bolt means are composed of silicon bronze material.

14. The ground rod clamp of claim 11 wherein said clamp body second portion defines a partial transverse bore, said transverse bore being substantially tangential to said axial bore.

15. The ground rod clamp of claim 14 further comprising pin means disposed in said transverse bore and engageable with said bolt means wherein said pin means resists movement of said bolt means, said pin means being composed of polymeric material.

16. A ground rod clamp comprising:

a clamp body having first and second portions, said first portion defining an axially elongated transverse opening, said opening having first, second and third sections, said first section having a radius R1, said second section having a radius R2, said third section having a radius R3, and wherein R1>R2>R3, said second portion defining a threaded axial bore and a partial transverse bore, said transverse bore being substantially tangential to said axial bore, said clamp body further comprising pin means disposed in said transverse bore, said pin means being comprised of polymeric material; and bolt means having head means and shank means, said shank means having a threaded segment, said threaded segment being threadably mounted in said axial bore, said threaded segment engaging said pin means whereby said pin means resists movement of said bolt means, said shank means being threadably displaceable into said opening.

17. The ground rod clamp of claim 16 wherein said shank means has a first portion intermediate said head means and said threaded segment, said first portion and said threaded segment each having a diameter wherein said threaded segment diameter is greater than said first portion diameter.

18. The ground rod clamp of claim 17 wherein said first portion diameter is dimensioned whereby said head means breaks away from said shank means when a predetermined torque is applied to said head means.

19. The ground rod clamp of claim 18 wherein said shank means has a second portion intermediate said first portion and said threaded segment, said second portion having opposed flat surfaces.

* * * * *